US011825972B2

(12) United States Patent
Grijalva et al.

(10) Patent No.: US 11,825,972 B2
(45) Date of Patent: Nov. 28, 2023

(54) PACKAGE RECEPTACLE

(71) Applicants: Roman Grijalva, Raeford, NC (US); Maritza Grijalva, Raeford, NC (US)

(72) Inventors: Roman Grijalva, Raeford, NC (US); Maritza Grijalva, Raeford, NC (US)

( * ) Notice: Subject to any disclaimer, the term of this patent is extended or adjusted under 35 U.S.C. 154(b) by 124 days.

(21) Appl. No.: 17/194,452

(22) Filed: Mar. 8, 2021

(65) Prior Publication Data

US 2021/0298507 A1 Sep. 30, 2021

Related U.S. Application Data

(60) Provisional application No. 62/994,983, filed on Mar. 26, 2020.

(51) Int. Cl.
*A47G 29/14* (2006.01)
*A47G 29/20* (2006.01)

(52) U.S. Cl.
CPC ..... *A47G 29/141* (2013.01); *A47G 29/20* (2013.01); *A47G 2029/144* (2013.01); *A47G 2029/145* (2013.01)

(58) Field of Classification Search
CPC ..... A47G 29/141; A47G 29/30; A47G 29/20; A47G 2029/144; A47G 2029/145; A47G 2029/147; A47G 2029/148; B65D 7/24; B65D 7/26; B65D 21/086; E05B 73/0005
USPC ..... 232/19, 45, 17, 38; 220/6, 666
See application file for complete search history.

(56) References Cited

U.S. PATENT DOCUMENTS 5,992,736 A * 11/1999 Parker ..... A47G 29/1201 232/17
6,375,070 B1 * 4/2002 Snoke ..... A47G 29/141 232/27
6,604,390 B1 * 8/2003 Nooner ..... A47G 29/20 70/30
7,256,691 B2 * 8/2007 Awobue ..... A47G 29/1214 340/569
9,364,112 B2 * 6/2016 Sundaresan ..... A47G 29/20
9,596,952 B2 * 3/2017 Mencel ..... A47G 29/20
9,873,549 B2 * 1/2018 Heinz ..... B65D 85/70
10,039,401 B1 * 8/2018 Romanucci ..... A47G 29/141
10,083,561 B2 * 9/2018 Sundaresan ..... G07C 9/00896
10,383,471 B1 * 8/2019 Barnes ..... A47G 29/124
D880,103 S * 3/2020 Quinn ..... D99/28
10,653,262 B1 * 5/2020 Isreal ..... A47G 29/20
10,743,694 B2 * 8/2020 Raphael ..... A47G 29/141
10,786,103 B2 * 9/2020 Teoh ..... B65D 11/1853
10,993,567 B1 * 5/2021 Cabral-McKeand ..... A47G 29/141
11,206,939 B2 * 12/2021 Sundaresan ..... A47G 29/1225
11,284,732 B2 * 3/2022 McCloskey, III ... A47G 29/141
11,311,132 B2 * 4/2022 Eivaz ..... A47G 29/141
11,330,926 B1 * 5/2022 Root ..... A47G 29/20
11,344,144 B2 * 5/2022 Curtis ..... A47G 29/124
11,369,222 B2 * 6/2022 Kennett ..... E05B 47/00
(Continued)

*Primary Examiner* — William L Miller
(74) *Attorney, Agent, or Firm* — Brennan, Manna & Diamond, LLC

(57) ABSTRACT

The present invention relates generally to a new and improved package receptacle for receiving one or more delivered parcels or packages. The receptacle is comprised of a gas-piston supported lid, a cable that allows the receptacle to be secured to a structure, a lock that allows only authorized users to access the contents of the package receptacle and a plurality of anti-theft mechanisms. The package receptacle is easily collapsible for easy transportation between locations.

16 Claims, 5 Drawing Sheets

(56) References Cited

U.S. PATENT DOCUMENTS

| | | | | |
|---|---|---|---|---|
| 11,382,445 | B2 * | 7/2022 | Quastad | A47G 29/20 |
| 2015/0305538 | A1 * | 10/2015 | Sundaresan | A47G 29/141 70/64 |
| 2016/0068306 | A1 * | 3/2016 | Heinz | A47G 29/141 220/6 |
| 2016/0309939 | A1 * | 10/2016 | Mencel | A47G 29/30 |
| 2017/0188737 | A1 * | 7/2017 | Hippert | A47G 29/20 |
| 2017/0286905 | A1 * | 10/2017 | Richardson | G06Q 10/0832 |
| 2018/0070753 | A1 * | 3/2018 | Eveloff | H04W 4/025 |
| 2018/0112439 | A1 * | 4/2018 | Darakdjian | E05B 73/0005 |
| 2018/0296016 | A1 * | 10/2018 | Teoh | A47G 29/20 |
| 2019/0038062 | A1 * | 2/2019 | Sundaresan | A47G 29/124 |
| 2019/0133362 | A1 * | 5/2019 | Gilligan | A47G 29/20 |
| 2019/0167025 | A1 * | 6/2019 | Cherry | A47G 29/16 |
| 2019/0231107 | A1 * | 8/2019 | Rampton | A47G 29/141 |
| 2019/0239650 | A1 * | 8/2019 | Nelson | E05B 65/5284 |
| 2019/0256119 | A1 * | 8/2019 | Brilhante | B62B 3/004 |
| 2019/0350398 | A1 * | 11/2019 | Raphael | A47G 29/141 |
| 2020/0077826 | A1 * | 3/2020 | Chenier | G07C 9/00912 |
| 2020/0107663 | A1 * | 4/2020 | Eivaz | A47G 29/141 |
| 2020/0268187 | A1 * | 8/2020 | Thomas | A47G 29/20 |
| 2020/0397172 | A1 * | 12/2020 | Kennett | G07C 9/00896 |
| 2021/0045563 | A1 * | 2/2021 | Bartley-Clark | A47G 29/141 |
| 2021/0196071 | A1 * | 7/2021 | Gecho | A47G 29/30 |
| 2022/0008578 | A1 * | 1/2022 | Raphael | A47G 29/141 |
| 2022/0183491 | A1 * | 6/2022 | Cooper | A47G 29/20 |
| 2022/0257041 | A1 * | 8/2022 | Redford | B65D 55/14 |

* cited by examiner

PACKAGE RECEPTACLE

CROSS-REFERENCE TO RELATED APPLICATION

The present application claims priority to and the benefit of U.S. Provisional Application No. 62/994,983 filed on Mar. 26, 2020, which is incorporated herein by reference in its entirety.

FIELD OF THE INVENTION

The present invention relates to an improved package receptacle. More specifically, the invention relates to a generally quadrate, square or rectangular package receptacle device that can both receive and secure a plurality of packages within the body of the device. The receptacle device is comprised generally of a container having a gas-piston supported lid, a fixedly attached cable that allows the receptacle device to be secured to a doorknob assembly and an automatic lock that allows only an authorized user to access the contents of the receptacle device. Additionally, the receptacle device has a collapsible and foldable body that can be disassembled or collapsed for easy transportation of the same between different locations. The body may also be locked in a folded or erect position via a plurality of spring-loaded retention pins to further improve the structural stability and transportation of the device. Accordingly, the present specification makes specific reference thereto. However, it is to be appreciated that aspects of the present invention are also equally amenable to other like applications, devices and methods of manufacture.

BACKGROUND OF THE INVENTION

Unattended packages are targeted and stolen from the front porches, sidewalks, entryways and other areas of a business or residence on a daily basis across the country. Lockboxes or similar-type package receptacle devices that are known in the art allow a delivery person to secure a package within the container such that it cannot be easily stolen by a thief before the owner of the package arrives and can remove it from the device. However, many such receptacle devices can still be stolen with the package inside, thereby defeating the purpose of the package receptacle. Further, such receptacle devices are oftentimes large, rigid and cumbersome to carry or transport from one location to another by the user. This is undesirable if a user must transport or otherwise move the receptacle device (e.g. as a gift, or when moving homes or changing business addresses).

Therefore, there exists a long felt need in the art for an improved package receptacle that is capable of both receiving and securing a package or a plurality of packages against theft. There is also a long felt need in the art for an improved package receptacle that not only protects the received package against theft, but that also prevents the package receptacle itself from being stolen with the received package(s) or other items inside. Moreover, there is a long felt need in the art for an improved package receptacle that can be easily transported and moved from one location to another location by an authorized user more efficiently, and with less effort that existing package receptacles known in the art. Additionally, there is a long felt need in the art for an improved package receptacle that notifies the user when a receptacle has been accessed (e.g., a package has been deposited) and of its position, for example, in the event of a theft. Finally, there is a long felt need in the art for an improved package receptacle that is relatively inexpensive to manufacture and that is both safe and easy to use.

The present invention in one exemplary embodiment, discloses a package receptacle device that secures a package against theft and includes a generally quadrate or rectangular collapsible or folding body. The interior of the body portion is sized and configured so that one or a plurality of packages can be placed inside the body of the receptacle to protect the packages or other items against theft or damage from the weather. The package receptacle further comprises a cable assembly and a retaining hook that is fixedly connected to the body of the receptacle and allows the device to be tethered to a doorknob, doorhandle-assembly hook or other structure which may be permanently affixed to the residence or business to prevent the theft of the container itself. In addition, the lid of the receptacle device has an automatic lock that locks the receptacle when the lid is closed or shut, as well as a sensor with GPS and wireless communication capabilities that notify the user via a mobile application when the receptacle has been accessed and/or its precise location on demand. The lid may also comprise a plurality of gas-piston-powered hinges that allow the lid to remain in an open position while accessing the interior space of the container to receive, deliver or remove a package or other item therefrom. Finally, the package receptacle may also be lined with an insulation so that food, beverages, medicines and other items that may need some protection from the heat or cold can be placed inside the receptacle without risk of spoilage.

In this manner, the improved package receptacle of the present invention accomplishes all of the forgoing objectives, thereby adequately securing one or more packages or other delivered items in a heated or cooled condition within the receptacle, and protecting the same and the receptacle itself from theft. Additionally, the package receptacle is easily transportable from one location to another by an authorized user, and has a plurality of mechanisms to notify a user if a theft is taking or has taken place. The novel package receptacle also provides both the user and law enforcement with a means to quickly locate and recover a stolen package receptacle.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises an improved package receptacle to receive and secure packages and other delivered items from theft until such time as they can be retrieved by an authorized user. The package receptacle is preferably comprised of a body portion, a repositionable lid attached to said body, a tether and an electronic component. The body portion is preferably a generally quadrate, rectangular or square structure that is collapsible, and that can fold inwards upon itself for easy transportation and/or storage when not in use. Nonetheless, other receptacle shapes are of course possible. For example, if routine deliveries are made that include a package having a unique shape or configuration, then the shape of the package receptacle may be configured to receive that particular shape or configuration.

The body of the package receptacle is preferably manufactured from a durable material such as, but not limited to, a plastic, aluminum, steel, etc., and may further comprise a plurality of spring-loaded retention pins that keep the body of the container in a folded or unfolded state, as selected by the user. The receptacle also includes a plurality of gas-piston hinges that support the receptacle lid in an open position relative to the body, such that no additional support is required by the user who may in turn use both hands to retrieve the delivered package from the receptacle (or place a package therein). The lid locks to the container body via an automatic locking mechanism. More specifically, the automatic locking mechanism comprises a male portion positioned on the receptacle lid for mating engagement with a corresponding female portion positioned along the body of the receptacle.

As noted above, the package receptacle also comprises a tether in the form of an integrated cable that allows the receptacle to be tethered and/or anchored to a doorhandle, doorknob, door or other fixture secured to a residence or other building via a noose, loop, ring or the like to further prevent the possibility of the theft of the receptacle and its contents. Additionally, the package receptacle further comprises a sensor, battery, GPS transmitter and a wireless communication module that is capable of notifying a remote user via a mobile application when the receptacle has been accessed and/or its precise location on demand, for example, in the event that the receptacle is stolen.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
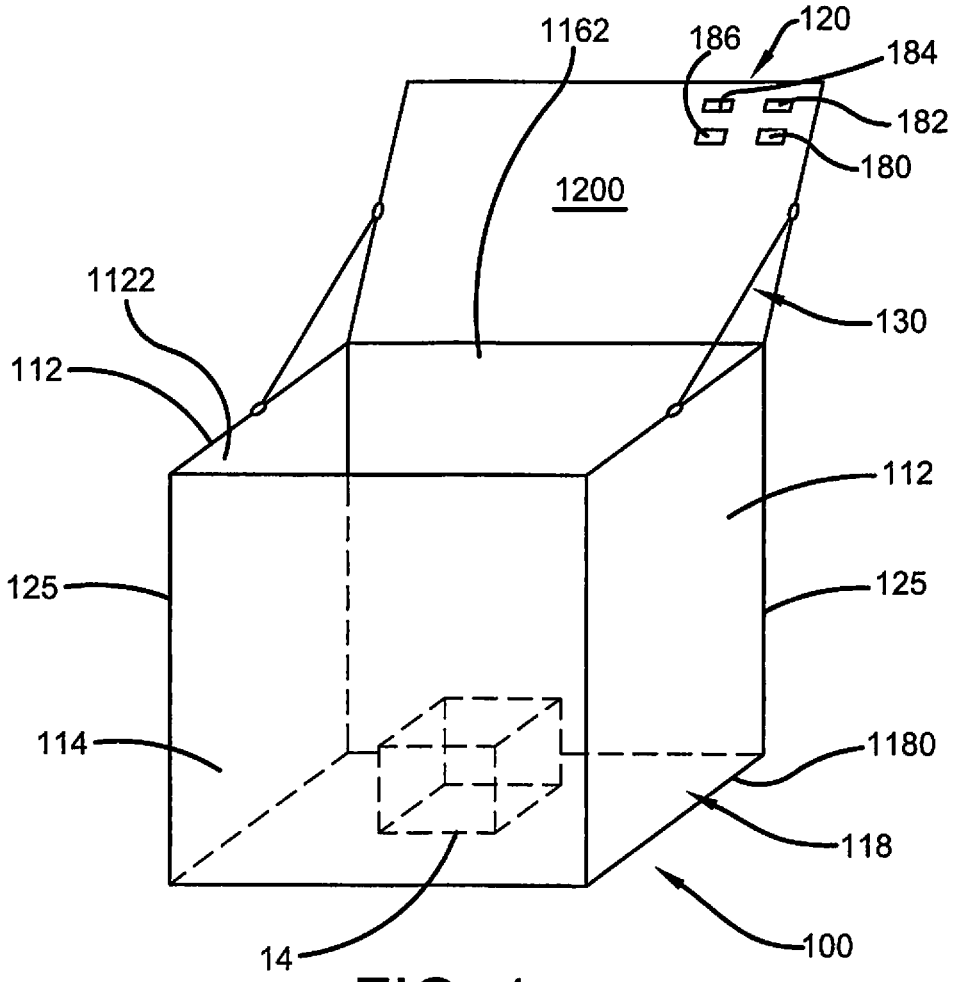
FIG. 1 illustrates a front perspective view of one potential embodiment of a package receptacle device of the present invention in accordance with the disclosed architecture, wherein the lid is in an open position and a package is contained inside the body of the receptacle device.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

As noted above, there is a long felt need in the art for an improved package receptacle that is capable of both receiving and securing a package therein, and protecting the received package and the receptacle device itself from being stolen. Moreover, there is a long felt need in the art for a package receptacle device that is collapsible when not in use for easy transportation and storage. Additionally, there is a long felt need in the art for an improved package receptacle that notifies the user when a receptacle has been accessed (e.g., a package has been deposited) and of its position, for example, in the event of a theft. Finally, there is a long felt need in the art for an improved package receptacle that is relatively inexpensive to manufacture and that is both safe and easy to use.

The package receptacle device of the present invention is designed to allow a user to secure one or more packages or other items within the interior of the receptacle to protect the same from theft. The receptacle has an automatic locking mechanism with a male portion of the mechanism being attached to the lid of the receptacle, and a female portion attached to the body portion of the receptacle. Both the male and female portions of the locking mechanism engage one another to lock the receptacle when the repositionable lid is in the closed position. The locking mechanism allows a user and/or a delivery person to access and deposit/retrieve a package or other item from the interior of the receptacle in a secured manner. Additionally, the package receptacle is secured to a doorknob assembly (e.g., of a front door) or other fixture of a residence of business via a cable assembly that prevents the receptacle itself from being stolen, with or without a package contained therein. The receptacle body further comprises a plurality of hinges that allow the receptacle body and lid portion to be entirely folded or collapsed to allow for easy transportation and storage when not in use. Further, specific sidewalls or surfaces of the body of the receptacle may include spring-loaded retention pins that ensure that the receptacle remains in a collapsed or erected state, as desired by the user. Finally, as explained more fully below, the package receptacle further comprises one or more electronic components to enhance user satisfaction and to further protect both the receptacle and articles stored therein from theft.

Referring initially to the drawings, FIG. 1 illustrates a front perspective view of one potential embodiment of a package receptacle device 100 of the present invention in accordance with the disclosed architecture, wherein the lid 120 is in an open position and a package 14 is contained inside the body 110 of the receptacle device 100. More specifically, the container 100 is preferably a generally quadrate, rectangular, or square shaped configuration, and is comprised of generally parallel and spaced apart side walls 112, a generally parallel and spaced apart front and rear walls 114, 116 respectively, a bottom surface 118, and a top surface in the form of a lid 120, which are disposed approximately perpendicular to the plurality of walls. The body portion 110 is preferably manufactured from a durable material such as, but not limited to, an aluminum, steel, metal, rigid plastic (including recycled plastics and post-consumer waste), wood (including wood from renewable or sustainably sourced areas or producers), etc. Notwithstanding, the package receptacle 100 of the present invention is not so limited and it is contemplated that a plurality of alternate shapes, sizes, and materials outside of those described herein can also be used. Additionally, for aesthetic purposes and to protect the package receptacle from the weather and other elements, each of the exterior surfaces of the body portion 110 and the lid 120 may further comprise a coating or a veneer 122 that may include, but is not limited to, a brick, siding, metal, stone, or other common residential exterior materials so that the appearance of the package receptacle 100 matches (or at least doesn't clash with) the exterior of the residence or building that it is tethered to. The veneer 12 may be comprised of a plurality of removable panels that can be removably attached via adhesive, a grooved channel, or other mechanical fastening means to the exterior surfaces of the body portion 110 so as to allow the owner to change the appearance of the container when the container is moved to another location.

Figure 2A:
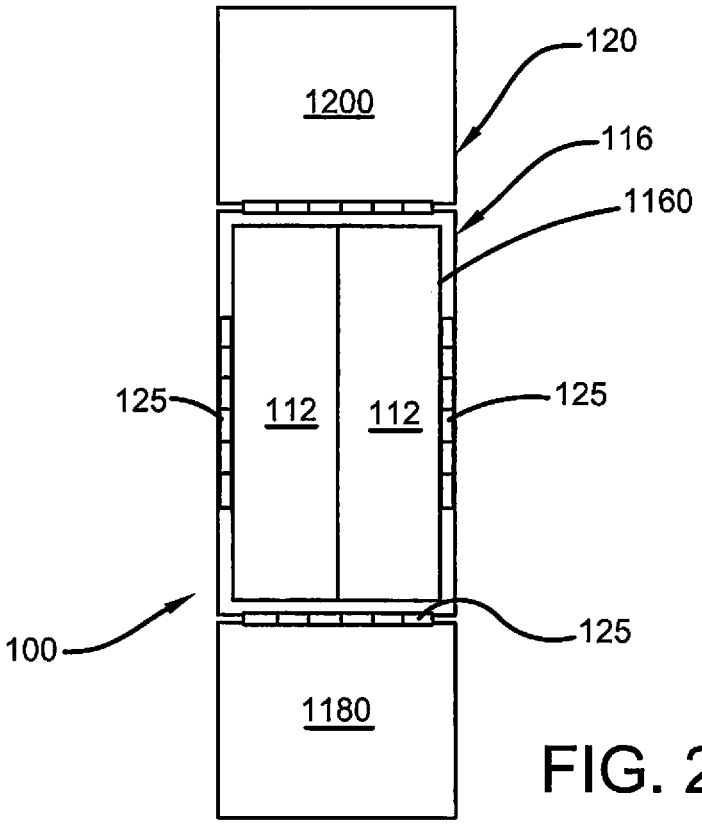
FIG. 2A illustrates a perspective top view of one potential embodiment of the package receptacle device of the present invention in a partially folded or collapsed state in accordance with the disclosed architecture.
Figure 2B:
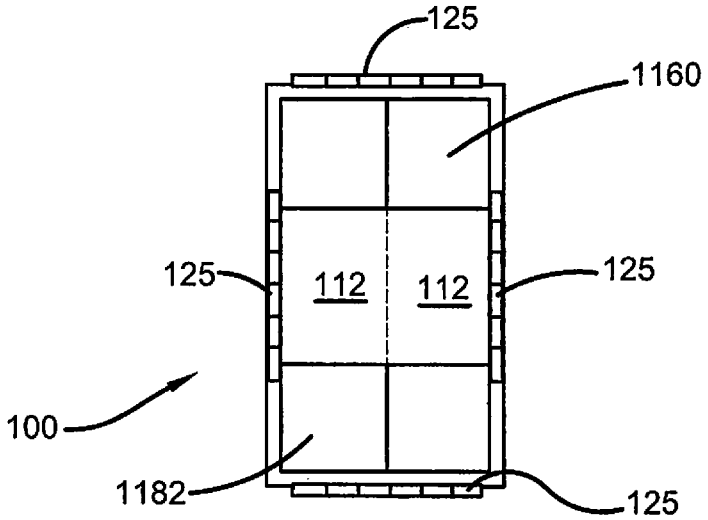
FIG. 2B illustrates a perspective top view of one potential embodiment of the package receptacle device of the present invention in a fully folded or collapsed state in accordance with the disclosed architecture.

FIG. 2A illustrates a perspective top view of one potential embodiment of the package receptacle device 100 of the present invention in a partially folded or collapsed state or condition, and FIG. 2B illustrates a perspective top view of the package receptacle device 100 in a fully folded or collapsed state in accordance with the disclosed architecture. More specifically, in order to be repositionable between an erect position and a folded or collapsed position, the body portion 110 has a plurality of hinges 125 that interconnect each of the lid 120, side walls 112, and bottom surface 118 to the rear wall 116. The hinges 125 then allow the side walls 116 to fold inwards (or outwards) to rest on the exterior or interior surface 1160/1162 of the rear wall 116, as can be seen in FIG. 2A. Further, the lid 120 and bottom surface 118 can also fold inwards (or outwards) to rest on the exterior or interior surface 1160/1162 of the rear wall 116, or upon the already folded side surfaces 112 as shown in FIG. 2B. It is further contemplated that the plurality of hinges 125 may be removable (e.g., secured via a mechanical fastener) or fixedly attached to any surface 112, 114, 116, 118 or the body 110 or the lid 120. Further, the hinge 125 itself is preferably a butt hinge that would allow both portions of the hinge 125 to remain attached to any two respective surfaces 112, 114, 116, 118, 120 while allowing the body portion 110 to disassemble for further portability by removing the central pin (not shown) from the hinge 125, thereby effectively separating the hinge 125 into two pieces. Nonetheless, it is also contemplated that in alternative embodiments of the package receptacle 100, the plurality of hinges 125 may also be comprised of other types of hinges including, but not limited to, offset blind hinges, knuckle hinges, butt hinges, rising butt hinges, gravity pivot hinges, ball bearing hinges, barrel hinges, concealed hinges, knife hinges, piano hinges, strap hinges, pivot hinges, etc.

When the receptacle 100 is in a folded or unfolded position, the body portion 110 may further be secured in the current position by a plurality of spring-loaded retention pins 125 that may be connected to a respective two of any of the following: the lid 120; the sidewalls 112, the front and rear walls 114, 116; or any portion of the body 110. Each pin 125 is preferably a spring-loaded structure that may be housed in one surface (e.g., the front wall 114 or bottom surface 118), but may horizontally engage a perpendicular surface (e.g., a sidewall 112) by releasing the spring such that a portion of the pin 125 protrudes from the spring body and engages an opening that may be present within the perpendicular surface. Once released, the spring ensures that the walls 112, 114, 116 remain stable, in-plane and do not bow outwards or inwards. For transporting purposes, each pin 125 can be pulled, which releases the spring and retracts the locking member such that the side walls 112 and front and rear surfaces 114, 116 can be folded inwards or outwards. It is then contemplated that the pins 125 can engage a differing set of openings within the lid 120, the sidewalls 112, front and rear walls 114, 116 or any portion of the body 110 thereof such that the body 110 can be secured in a folded or collapsed position to ensure the various components of the body portion 110 do not move during transport. It is contemplated that any surface 112, 114, 116, 118, of the body portion 110 of the lid 120 may have the pins 125 in any arrangement, number and/or positioning such that the pins 125 may be embedded within the surface 112, 114, 116, 118, 120, or exposed on the interior or exterior portion of said surfaces. Further, in differing embodiments of the device 100, the pin 125 may take the form of other pin types such as, but not limited to, spring pins, cotter pins, taper pins, lynch pins, spire pins, split pins, etc.

Additionally, the bottom surface 1180 of the body portion 110 may further comprise a plurality of openings 161 that allow a bolt, screw or other fastener to be inserted through the opening 161 to effectively bolt the package receptacle device 100 to the floor, thereby further reducing the likelihood of theft. Each of the rear wall 116, side walls 112 or front wall 114 may also comprise similar tab openings 163 so that the package receptacle 100 can be attached or bolted to a vertical surface such as a wall. The bottom surface 118 may also have a hollow cavity, pocket or continuous opening 165 with a cover, wherein the user may place a plurality of weights (e.g. metal weights, water, sand, etc.) to further make the package receptacle 100 more difficult to steal due to its increased weight.

Figure 3:
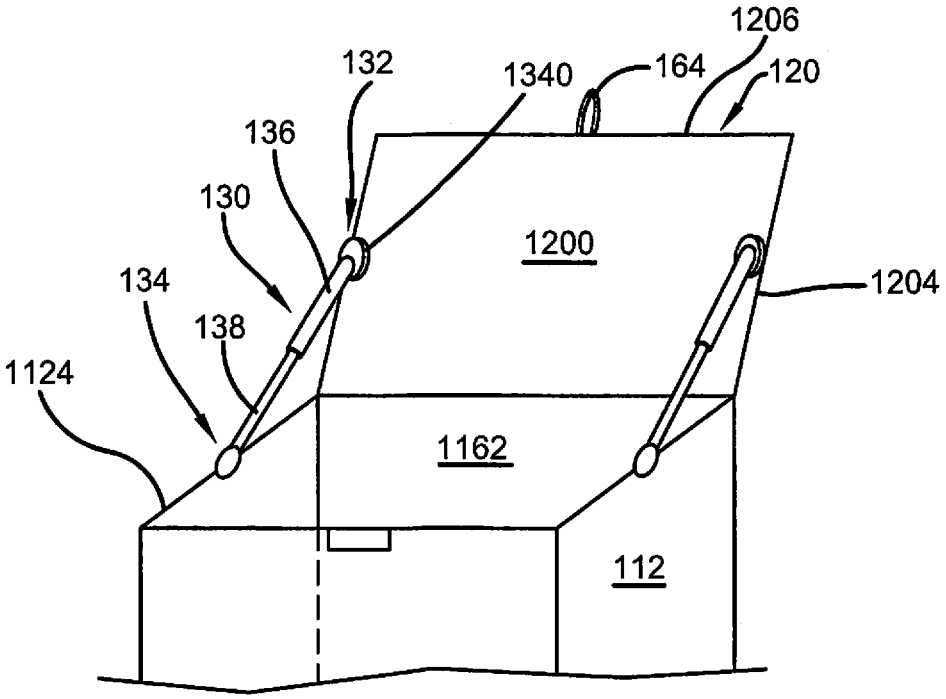
FIG. 3 illustrates a perspective view of one potential embodiment of a package receptacle device of the present invention in accordance with the disclosed architecture, wherein the lid is in an open position and the pair of gas pistons are fully displayed.

FIG. 3 illustrates a perspective view of one potential embodiment of a package receptacle device 100 of the present invention in accordance with the disclosed architecture, wherein the lid 120 is in an open position, and the pair of gas pistons 130 are fully displayed. More specifically, the lid 120 is comprised of a top surface 1202, a bottom surface 1200, a pair of generally parallel side surfaces 1204, a front surface 1206, and a rear surface 1208. The lid 120 is preferably attached to at least one side wall 112 or the front or rear walls 114, 116 via at least one hinge 125. As noted above, the hinge 125 allows the lid 120 be repositioned between an open position and a closed position, and also permits the lid 120 to fold flat against the body portion 110 for transport purposes. The lid 120 also has a lock assembly 160 that secures the lid 120 to the front surface 114 of the body 110 when in the closed position such that the package receptacle 100 and its contents cannot be accessed when the lock assembly 160 is engaged.

In the preferred embodiment of the package receptacle, the lock assembly 160 comprises a male portion 162 that is fixedly secured to the front surface 114, and a corresponding female portion 164 that is fixedly secured to the front surface 1206 of the lid 120. The female portion 164 may further include a buckle-like member 1640 with a continuous opening 1642 therein that is engaged by a protrusion on the male portion 162 in the locked position, but is depressed in the unlocked position wherein the male portion 162 can separate from the female portion 164.

Nonetheless, in alternative embodiments of the package receptacle 100, the locking assembly 160 can be positioned along any portion or surface of the side walls 112, front wall 114 or rear wall 116 and/or lid 120, and/or may be additionally or alternatively comprised of a plurality of differing lock types. One such embodiment may comprise a Bluetooth lock 160. The Bluetooth lock 160 may have a Bluetooth transmitter or wireless communication module 186 that allows the lock 160 to be in electrical communication with a smart device 188 (e.g. mobile phone) of a user. A user (which may include a homeowner and/or a delivery person) can then utilize a mobile application 187 to remotely lock/unlock the lock assembly 160 to access the contents of, or deposit a package into, the interior of the container body 110.

In yet a further embodiment of the present invention, the locking mechanism 160 may be a biometric lock that has a fingerprint scanner (not shown), wherein a user or delivery person may program their fingerprint(s) into the lock to access the contents of the body 110 or to deposit a package into the body 110. Further, the locking mechanism 160 may also be any of a physical or digital keypad, a physical key or a physical rotating dial code. Alternatively, the locking mechanism 160 may be in the form of a face scanner (not shown), or an RFID lock 171 that includes a RFID reader which is in electrical communication with an RFID key fob, or a magnetic lock.

As also best illustrated in FIG. 3, the lid 120 is supported by at least one, and preferably two, gas-piston type hinges 130. The hinges 130 comprise a first end 132 that has a mounting bracket 1320 that is fixedly or removably attached to the bottom surface 1200 of the lid 120, and a second end 134 that has a mounting bracket 1340 that is fixedly or removably attached to the interior surface 1122 of the sidewalls 112 near the top edge 1124. Nonetheless, in alternative embodiments, the hinges 130 may be on the interior surface 1142, 1162 of the front and rear walls 114, 116 respectively. Each of the hinges 130 has a generally cylindrical housing 136 that houses a gas piston system (not shown) that further engages a piston shaft 138 which retracts and extends from the housing 136 to allow the lid 120 to open and close. Ultimately, the hinge 130 allows the lid 120 to remain in an open position while unsupported by a user so that packages and other items can be easily inserted or removed from the container 100 without requiring the user to use one hand to support the lid 120 while doing so.

Figure 4A:
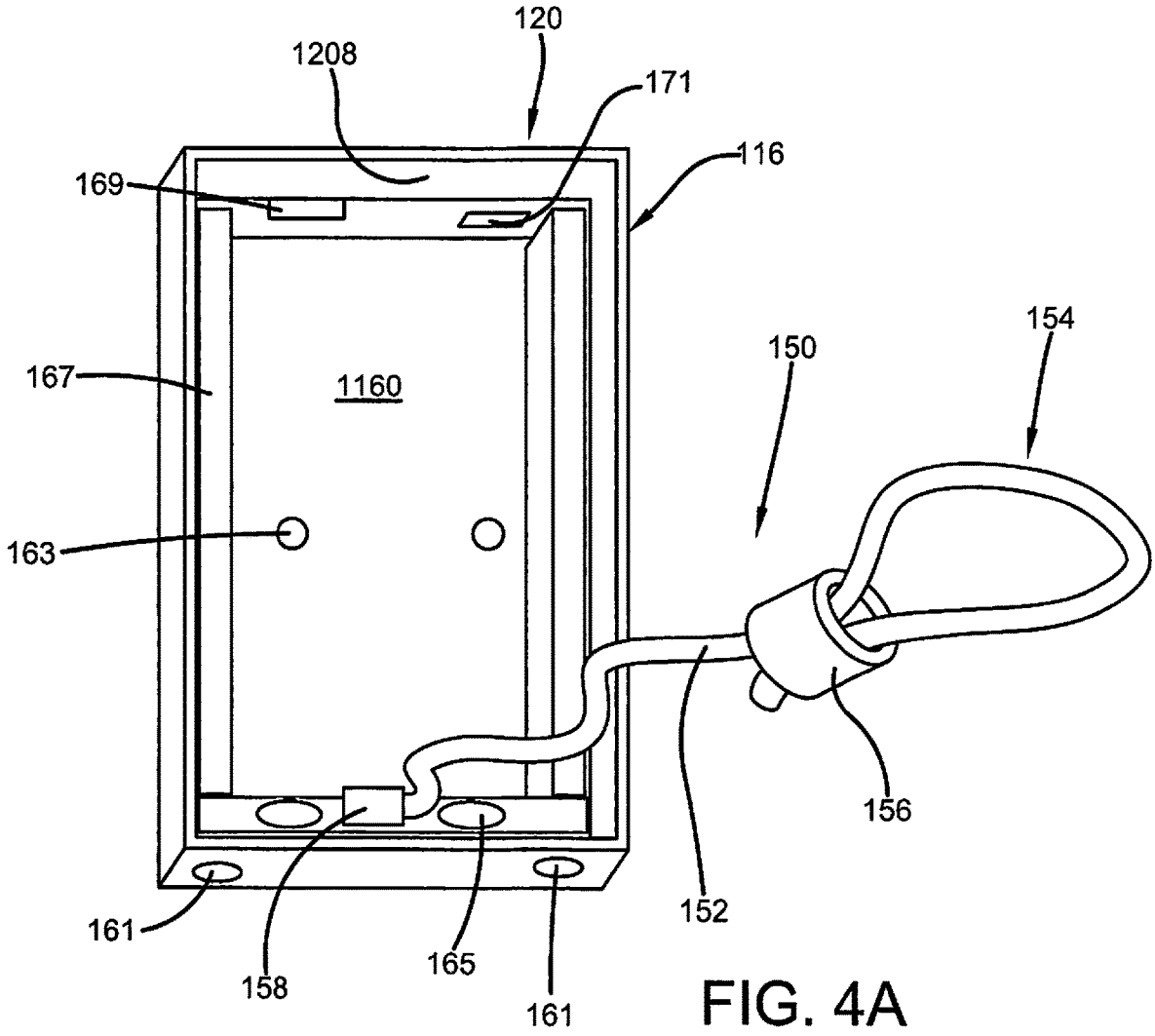
FIG. 4A illustrates a perspective rear view of one potential embodiment of the cable assembly and the package receptacle device of the present invention in accordance with the disclosed architecture.

FIG. 4A illustrates a perspective rear view of one potential embodiment of the cable assembly 150 of the package receptacle device 100 of the present invention in accordance with the disclosed architecture. More specifically, the rear surface 116 of the body portion 110 comprises a fixedly attached anchor point 158 that allows the cable assembly 150 to be attached to the body 110. The cable assembly 150 is comprised of a cable 152 that may be manufactured from any number of differing durable materials, such as steel cables or chains, braided metals, Kevlar, etc., such that the material is sufficiently strong to prevent an individual from attempting to remove or cut the cable 152 from the container body 110 in order to steal the package receptacle 100. Nonetheless, in alternative embodiments of the package receptacle 100, the cable assembly 150 may be attached to any of the surfaces of 112, 114, 116, 118 of the body portion 110 or lid 120 and may be removable, but only in a manner accessible to the user such as a locked housing which may be on the interior or exterior of the body portion 110.

FIG. 4A also illustrates a removable insulation layer 167 that can be inserted into the interior of the body portion 110 when the recipient anticipates receiving perishable goods such as, but not limited to, food, beverages, medicines and other items that may need some protection from the heat or cold. In a further preferred embodiment, the package receptacle may also comprise a thermometer or other temperature sensor 169 so that the user can always determine the temperature in the interior of the body portion.

Figure 4B:
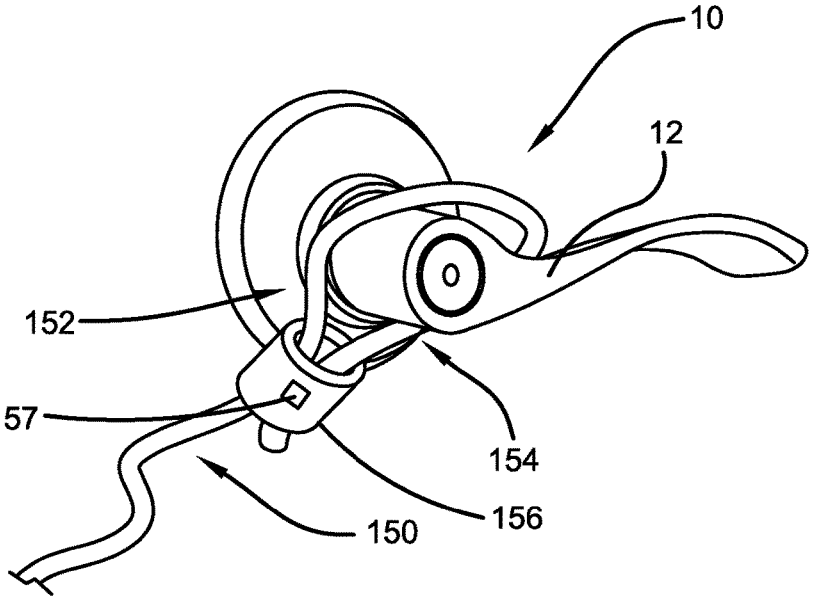
FIG. 4B illustrates a perspective view of one potential embodiment of the cable assembly of the package receptacle device of the present invention secured around a doorknob assembly in accordance with the disclosed architecture.

FIG. 4B illustrates a perspective view of one potential embodiment of the cable assembly 150 of the package receptacle device 100 of the present invention secured around a doorknob assembly 10 in accordance with the disclosed architecture. More specifically, the cable assembly 150 can be used to tether the package receptacle 100 to a doorknob assembly 10 or other residential or business fixture such as, but not limited to, an anchoring point, faucet, railing, flagpole or the like. In order to be secured around the handle 12 of a doorknob assembly 10, the cable 152 has a loop, ring, noose or other closed end 154 which is looped around the doorknob handle 12 or other fixture. The loop 154 further includes a clasp 156 that ensures that the loop, ring, noose or other closed end 154 retains its shape and allows the loop, ring, noose or other closed end 154 to tighten or loosen around the door handle 12. Similar to the anchor point 158, the clasp 156 may include a locking means 157 in the form of a key lock, dial code lock, etc. that allows the user to loosen or tighten the clasp 156, but that does not allow a would-be thief to loosen or remove the clasp 156.

Figure 5:
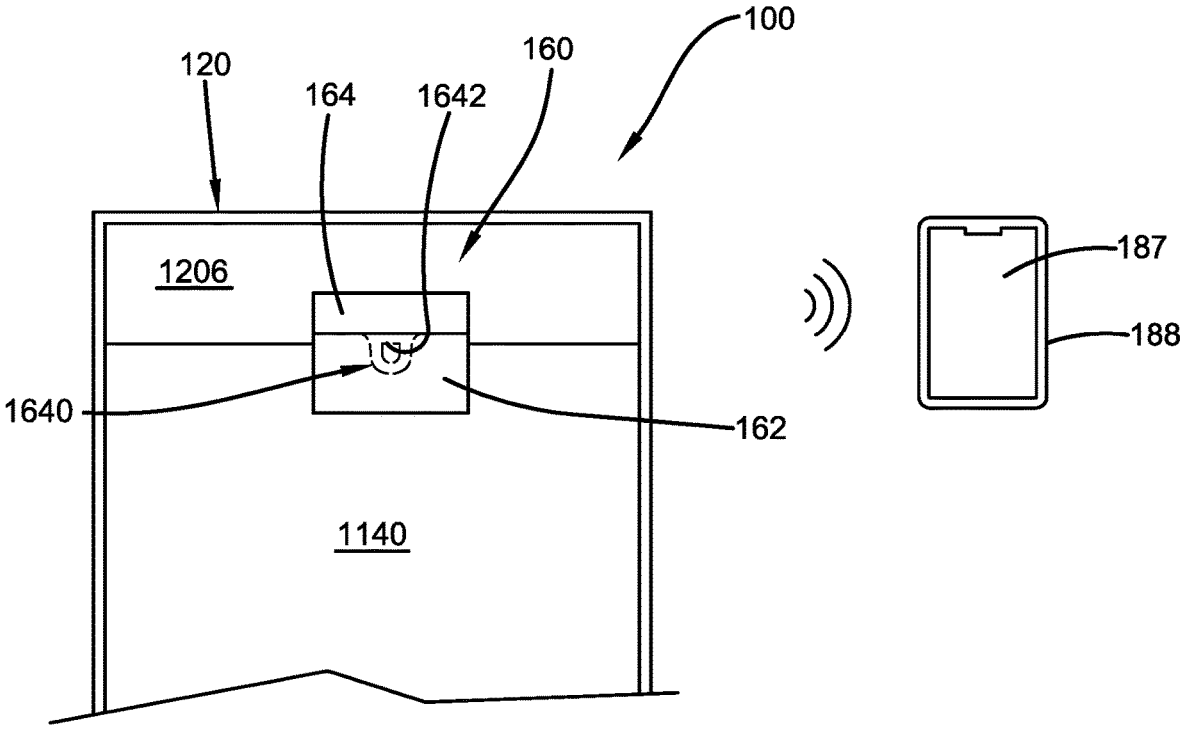
FIG. 5 illustrates a partial perspective front view of one potential embodiment of the package receptacle device of the present invention in accordance with the disclosed architecture, wherein the lid is in a closed and locked position and the device is in wireless communication with a mobile application installed on a smart device.

FIG. 5 illustrates a partial perspective front view of one potential embodiment of the package receptacle device 100 of the present invention in accordance with the disclosed architecture, wherein the lid 120 is in a closed and locked position and the wireless communication module 186 is in wireless communication with a mobile application 187 installed on a smart device 188. More specifically, and as best shown in FIG. 1, the package receptacle 100 preferably comprises a motion sensor 180, a battery 182, a GPS transmitter 184, and a wireless communication module 186, wherein the battery 182 provides power to each of the forgoing and may be a disposable or rechargeable battery. The motion sensor 180 detects motion in close proximity to the receptacle 100, such as when the lid 120 is opened or closed and may be in wired or wireless communication with the wireless communication module 186 such that a notification can be sent to the user's smart phone 188 alerting him or her to the event via the mobile application 187. Further, in the event that the package receptacle 100 is stolen, the GPS transmitter 184 can help the owner and or law enforcement quickly determine the location of the same. All wireless communications can be made via Bluetooth, RFID, NFC, LTE/4G/5G or any other known wireless communication technology.

Notwithstanding the forgoing, the package receptacle 100 and its various components can be of any suitable size, shape, and configuration as is known in the art without affecting the overall concept of the invention, provided that they accomplish the above-stated objectives. One of ordinary skill in the art will appreciate that the shape and size of the package receptacle 100 and its various components as shown in the FIGS. are for illustrative purposes only, and that many other shapes and sizes of the package receptacle 100 are well within the scope of the present disclosure. Although dimensions of the package receptacle 100 and its components (i.e., length, width, and height) are important design parameters for good performance, the package receptacle 100 and its various components may be of any shape or size that ensures optimal performance during use and/or that suits user need and/or preference.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A package receptacle comprising:

a plurality of side walls, a bottom and a lid, wherein the lid is connected to one of the plurality of side walls by a hinge and is repositionable between an open position and a closed position;

an enclosure defined by the plurality of side walls, the bottom and the lid, wherein the enclosure is sized and configured to receive at least one package;

a pair of supports to hold the lid in the open position;

at least one pin in at least one of the plurality of side walls and the bottom;

a locking mechanism; and a cable assembly for securing the package receptacle to a door handle, the cable assembly comprising a cable comprising a fixed anchor at one end for attaching the cable to one of the plurality of sidewalls and a closed end at an opposing end for engaging the door handle and a locking clasp for adjustably securing the closed end to the door handle.

2. The package receptacle as recited in claim 1, wherein the cable is manufactured from a select one of a steel, a Kevlar or a braided metal.

3. The package receptacle as recited claim 1 further comprising a motion sensor, a battery and a wireless communication module.

4. The package receptacle as recited in claim 3 further comprising a GPS transmitter.

5. The package receptacle as recited in claim 3, wherein the wireless communication module is wirelessly paired to a remote electronic device.

6. The package receptacle as recited in claim 1, wherein the locking mechanism is comprised of a select one or a RFID reader, a biometric scanner, a key pad and a keyed lock.

7. The package receptacle as recited in claim 1, wherein the bottom further comprises one or more pockets for receipt of a weight.

8. The package receptacle as recited in claim 1 further comprising a removable insulation layer and a thermometer.

9. The package receptacle as recited in claim 1 further comprising at least one opening for securing the package receptacle to a surface, wherein the at least one opening is positioned along the bottom or at least one of the plurality of side walls.

10. The package receptacle as recited in claim 1, wherein the at least one pin is positioned at a corner formed by at least one of the plurality of side walls and the bottom.

11. A package receptacle comprising a generally quadrate or rectangular structure comprised of a plurality of side walls, a bottom and an interior;

a lid hingedly connected to at least one of the plurality of side walls the lid comprising a removable veneer attachable to an exterior surface of the lid;

at least one gas cylinder extending between the lid and at least one of the plurality of side walls to hold the lid in an open position;

a cable connected to at least one of the plurality of side walls or the bottom, the cable comprising a first end having a ring for tethering the package receptacle to a structure, wherein the cable further comprises an adjustment mechanism for altering a size of the ring; and a lock for securing the lid in a closed position.

12. The package receptacle as recited in claim 11 further comprising a plurality of removable pins for joining the plurality of side walls to the bottom.

13. The package receptacle as recited in claim 11 further comprising a motion sensor, a battery, a GPS transmitter and a wireless communication module.

14. The package safe as recited in claim 11, wherein the lock is comprised of a select one or a RFID reader, a biometric scanner, a key pad and a keyed lock.

15. A package delivery container comprising:

a container having a plurality of side walls, a bottom and a lid comprising a removable veneer attachable to an exterior surface of the lid, wherein the container is repositionable between a deployed position and a collapsed position and the lid is repositionable between an open position, a closed position, and a position flat against one of the sidewalls;

the plurality of side walls and the bottom are connected to one another through a plurality of removable pins, wherein the plurality of removable pins hold the container in either the deployed position or in the collapsed position;

a lock for securing the lid in the closed position; and a cable assembly for securing the package receptacle to a door handle, the cable assembly comprising a cable comprising a fixed anchor at one end for attaching the cable to one of the plurality of sidewalls and a closed end at an opposing end for engaging the door handle and a locking clasp for adjustably securing the closed end to the door handle.

16. The package delivery container as recited in claim 15, further comprising a weight disposed on the bottom, a removable insulation layer, a thermometer, a wireless communication module, a battery, a GPS sensor and a motion sensor.

* * * * *